US008235539B2

(12) United States Patent
Thomas et al.

(10) Patent No.: US 8,235,539 B2
(45) Date of Patent: Aug. 7, 2012

(54) ELONGATED LED LIGHTING FIXTURE

(75) Inventors: James Thomas, Tierra Verde, FL (US); David Lynd, Seminole, FL (US); Gary Gatesman, Rocks Bch., FL (US); Jim Mosier, St. Petersburg, FL (US); Bryan T. Warner, St. Pete, FL (US)

(73) Assignee: ElectraLED, Inc., Largo, FL (US)

( * ) Notice: Subject to any disclaimer, the term of this patent is extended or adjusted under 35 U.S.C. 154(b) by 274 days.

(21) Appl. No.: 11/821,793

(22) Filed: Jun. 25, 2007

(65) Prior Publication Data

US 2008/0037239 A1 Feb. 14, 2008

Related U.S. Application Data

(60) Provisional application No. 60/817,913, filed on Jun. 30, 2006.

(51) Int. Cl.
*F21V 33/00* (2006.01)

(52) U.S. Cl. ..... 362/92; 362/93; 362/94

(58) Field of Classification Search ..... 362/92–94, 362/217.01, 218, 219, 221, 222, 223, 225, 362/217.1–217.17
See application file for complete search history.

(56) References Cited

U.S. PATENT DOCUMENTS

| | | | |
|---|---|---|---|
| 3,936,686 | A | 2/1976 | Moore |
| 4,143,411 | A | 3/1979 | Roberts |
| 4,149,217 | A | 4/1979 | Tucker |
| 4,416,411 | A | 11/1983 | Desmond et al. |
| 4,612,206 | A | 9/1986 | Shimozato et al. |
| 4,612,606 | A | 9/1986 | Roberts |
| 4,720,773 | A | 1/1988 | Ahroni |
| 4,855,882 | A | 8/1989 | Boss |
| 4,908,743 | A | 3/1990 | Miller |
| 5,015,918 | A | 5/1991 | Copeland |
| 5,103,382 | A | 4/1992 | Kondo et al. |
| 5,222,799 | A | 6/1993 | Sears et al. |
| 5,499,170 | A | 3/1996 | Gagne |
| 5,526,236 | A | 6/1996 | Burnes et al. |
| 5,607,227 | A | 3/1997 | Yasumoto et al. |
| 5,697,175 | A | 12/1997 | Schwartz |
| 5,746,497 | A | 5/1998 | Machida |
| 5,857,767 | A | 1/1999 | Hochstein |
| 5,892,192 | A | 4/1999 | Ishiguro et al. |
| 5,924,785 | A | 7/1999 | Zhang et al. |
| 5,931,577 | A | 8/1999 | Ishibashi |
| 6,045,240 | A | 4/2000 | Hochstein |
| 6,072,280 | A | 6/2000 | Allen |

(Continued)

*Primary Examiner* — William Carter
(74) *Attorney, Agent, or Firm* — McDermott Will & Emery LLP

(57) ABSTRACT

The invention provides an elongated lighting fixture with multiple light emitting diodes (LEDs) arrayed in two groups that are angled to each other. The fixture provides an extremely broad light emitting angle and includes an elongated housing having a pair of side walls with at least one fin to dissipate heat. Each side wall has a support member extending upward at angle from the side wall, wherein the side walls terminate at a central wall. A generally transparent cover is connected to the housing and extends between opposed ends of the housing. A first elongated fastener and a second elongated fastener are utilized to mount a first group of LEDs and a second group of LEDs to the first support member and the second support member, respectively. First and second interconnection board assemblies are affixed to respective support members beneath the group of LEDs by the first and second fasteners. When the first and second interconnection board assemblies are energized by an internal power source, current travels from each interconnection assembly through the fasteners to each group of LEDs for illumination.

28 Claims, 7 Drawing Sheets

U.S. PATENT DOCUMENTS

| | | | | |
|---|---|---|---|---|
| 6,116,748 | A | 9/2000 | George | |
| 6,137,648 | A | 10/2000 | Higurashi | |
| 6,183,104 | B1 | 2/2001 | Ferrara | |
| 6,244,728 | B1 | 6/2001 | Cote et al. | |
| 6,283,612 | B1 | 9/2001 | Hunter | |
| 6,346,777 | B1 | 2/2002 | Kim | |
| 6,350,039 | B1 | 2/2002 | Lee | |
| 6,371,637 | B1 | 4/2002 | Atchinson et al. | |
| 6,394,626 | B1 | 5/2002 | McColloch | |
| 6,396,466 | B1 | 5/2002 | Pross et al. | |
| 6,416,200 | B1 | 7/2002 | George | |
| 6,431,728 | B1 | 8/2002 | Fredericks et al. | |
| 6,573,536 | B1 | 6/2003 | Dry | |
| 6,578,979 | B2 * | 6/2003 | Truttmann-Battig | 362/92 |
| 6,578,986 | B2 | 6/2003 | Swaris et al. | |
| 6,617,520 | B1 | 9/2003 | Martter et al. | |
| 6,641,283 | B1 | 11/2003 | Bohler | |
| 6,665,170 | B1 | 12/2003 | Warner et al. | |
| 6,712,486 | B1 | 3/2004 | Popovich et al. | |
| 6,815,724 | B2 | 11/2004 | Dry | |
| 6,831,303 | B2 | 12/2004 | Dry | |
| 6,846,093 | B2 | 1/2005 | Swaris et al. | |
| 7,114,831 | B2 | 10/2006 | Popovich et al. | |
| 7,121,675 | B2 | 10/2006 | Ter-Hovhannisian | |
| 7,350,955 | B2 * | 4/2008 | Chang et al. | 362/249.01 |
| 2001/0015891 | A1 | 8/2001 | Suzuki et al. | |
| 2003/0218878 | A1 | 11/2003 | Swaris et al. | |
| 2005/0259424 | A1 * | 11/2005 | Zampini et al. | 362/294 |
| 2005/0265019 | A1 * | 12/2005 | Sommers et al. | 362/217 |
| 2007/0153508 | A1 * | 7/2007 | Nall et al. | 362/219 |
| 2007/0291473 | A1 * | 12/2007 | Traynor | 362/225 |

* cited by examiner

ELONGATED LED LIGHTING FIXTURE

CROSS-REFERENCE TO RELATED APPLICATIONS

This Application claims the benefit of U.S. Provisional Application No. 60/187,913 which was filed on Jun. 30, 2006.

FEDERALLY SPONSORED RESEARCH OR DEVELOPMENT

Not applicable.

TECHNICAL FIELD

The invention relates to an elongated lighting fixture with multiple light emitting diodes (LEDs) arrayed in two groups that are angled to each other. The fixture includes an elongated housing with two angled support members to which an array of LED modules are mounted, an electrical interconnection board affixed to an inner surface of each support member, a curvilinear cover, and an internal power supply. The fixture may also include bypass circuitry to prevent multiple LED modules from not illuminating, and remote operations capability.

BACKGROUND OF THE INVENTION

There currently exists a number of lighting fixtures utilizing LEDs as the light source. While such fixtures provide some beneficial features, they nevertheless suffer from a number of limitations, including but not limited to, uneven light distribution and brightness, high material and component costs, difficult and time-consuming assembly, and cumbersome housing configurations that hamper installation and thus prevent custom applications. An example of a lighting fixture suffering from the above limitations is disclosed in U.S. Pat. No. 6,283,612. There, the fixture comprises a hollow tube 20 with a single, linear array of LEDs 44 extending from a printed circuit board 22, along with a plurality of resistors 38. The bottom 26 of the board 22 has a full length conductive bus 28 and a full length conductive negative bus 30, with each bus 28, 30 located adjacent an opposed outside edge of the board 22. The anode 46 of the LED 44 is in communication with a second lead 42 of one of the resistors 38, and the cathode 48 is in communication with an adjacent LED 44 connected in series. A pair of end caps 50 are hermetically sealed to the tube 20 with adhesive 54 to secure the circuit board 22 within the tube 20, where the end caps 50 have a bore 56 that accept a cord 60. A resilient gasket 58 is disposed between the circuit board 22 and each end cap 50 to further secure the circuit board 22 within the hollow tube 20. An external power supply 64 provides direct current power to the single array of LEDs 44. A U-shaped mounting bracket 66 is utilized to mount the tube 20 for installation. Because the LEDs 44 are linearly arranged in a single plane, the tube 20 produces a limited range of light that is uneven and susceptible to undesirable "hot spots." This poor lighting performance renders the tube 20 commercially unfeasible.

The present invention seeks to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY OF THE INVENTION

The present invention is directed to a lighting fixture having two groups or arrays of LED modules that are angularly positioned to each other to produce a broad range of illumination. The fixture includes an elongated housing with angled support members, a group of LEDs mounted to each support member, opposed end walls, and a cover that couples to the housing and extends between the end walls. The housing further includes a wing extending from a lowermost region of each support member wherein the wing blocks glare from the LEDs during operation of the fixture. Each LED is part of a module that is connected to an outer surface of one of the support members by a pair of elongated fasteners. An interconnection bus is energized by an internal power supply and is positioned within a channel adjacent an inner surface of each support member by the fasteners. Current flows from the interconnection bus through the fasteners to the module to illuminate the LED thereon. Preferably, each group of LEDs includes a number of modules affixed to a support member. Because the support members are angularly oriented, the two groups of LEDs are similarly angled. The angled orientation of the two LED groups increase the light distribution angle of the fixture, thereby increasing the lighting performance of the fixture.

According to an aspect of the invention, the fixture includes bypass circuitry that prevents an entire string or array of LEDs from not illuminating when one LED in the string malfunctions or fails. The fixture also includes a radio frequency control unit that allows an operator to remotely control the fixture or group of fixtures, including turning the fixtures on, off, or dimming the brightness of the fixtures.

Due to the angled mounting of the two groups of LED modules, the fixture's light emitting angle is significantly greater than conventional fixtures having LEDs arrayed in a single plane. In addition to having a broader light emitting angle and light pattern, the fixture has a longer service life, is more durable and operates more efficiently, both electrically and thermally, than conventional light fixtures including neon, fluorescent, cold cathode, halogen, high-pressure sodium, metal halide, and incandescent. The LED modules increase the utility of the fixture for cold temperature applications, since cold temperatures extend the operating life of the LEDs. Along these lines, the fixture is especially well-suited for use in coolers and freezers, including open-top versions and those with doors, and cold food lockers. The fixture can also be used as original equipment or retrofit in connection with product displays and racks, backlighting, and indirect or ambient applications, regardless of the temperature environment. For example, the fixture can be configured for indirect architectural use, such as a cove fixture in retail stores.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
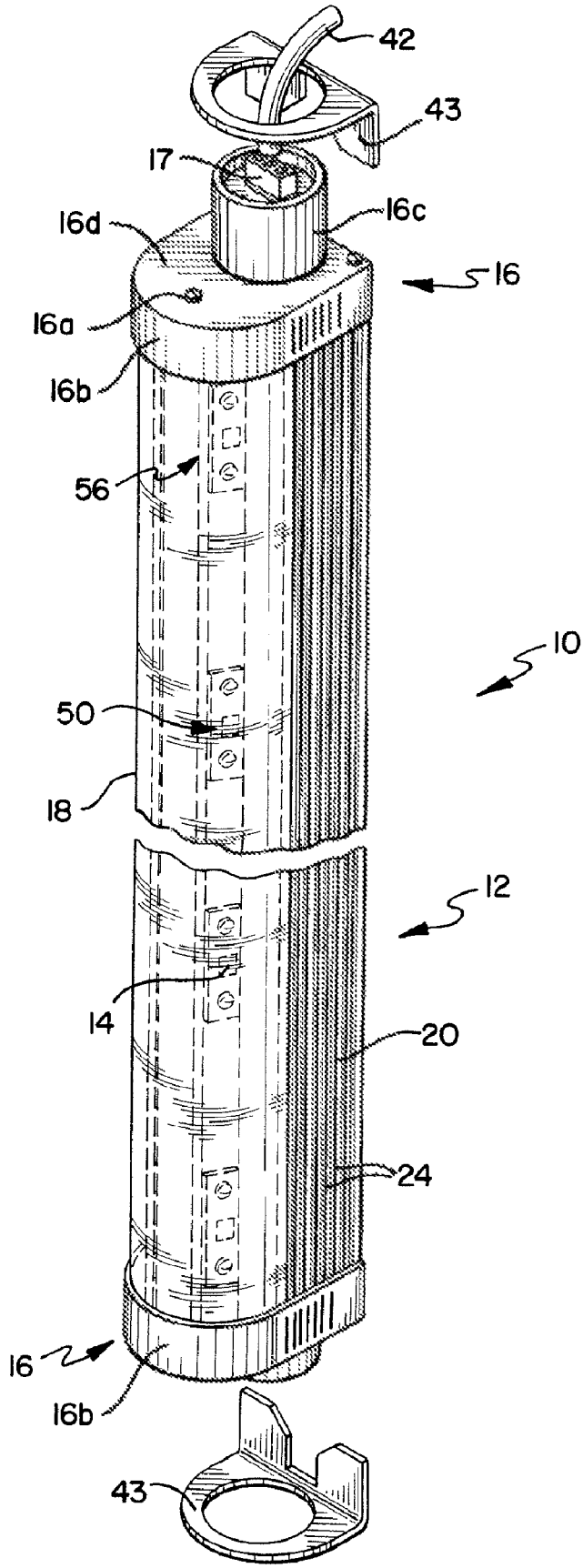
FIG. 1 is a perspective view of a light fixture of the invention.

While this invention is susceptible of embodiments in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIGS. 1-7 show an elongated lighting fixture 10 of the present invention. The fixture 10 comprises an elongated extrusion or housing 12, at least two light emitting diodes (LEDs) 14 angularly mounted within the housing 12, opposed end caps 16, and a generally transparent cover 18 that couples to the housing 12 and extends between the end plates 16. As explained in greater detail below, the fixture 10 includes two groups of uniquely positioned LEDs 14 that improve the operating performance of the fixture 10 while lowering the material and assembly costs of the fixture 10.

Figure 2:
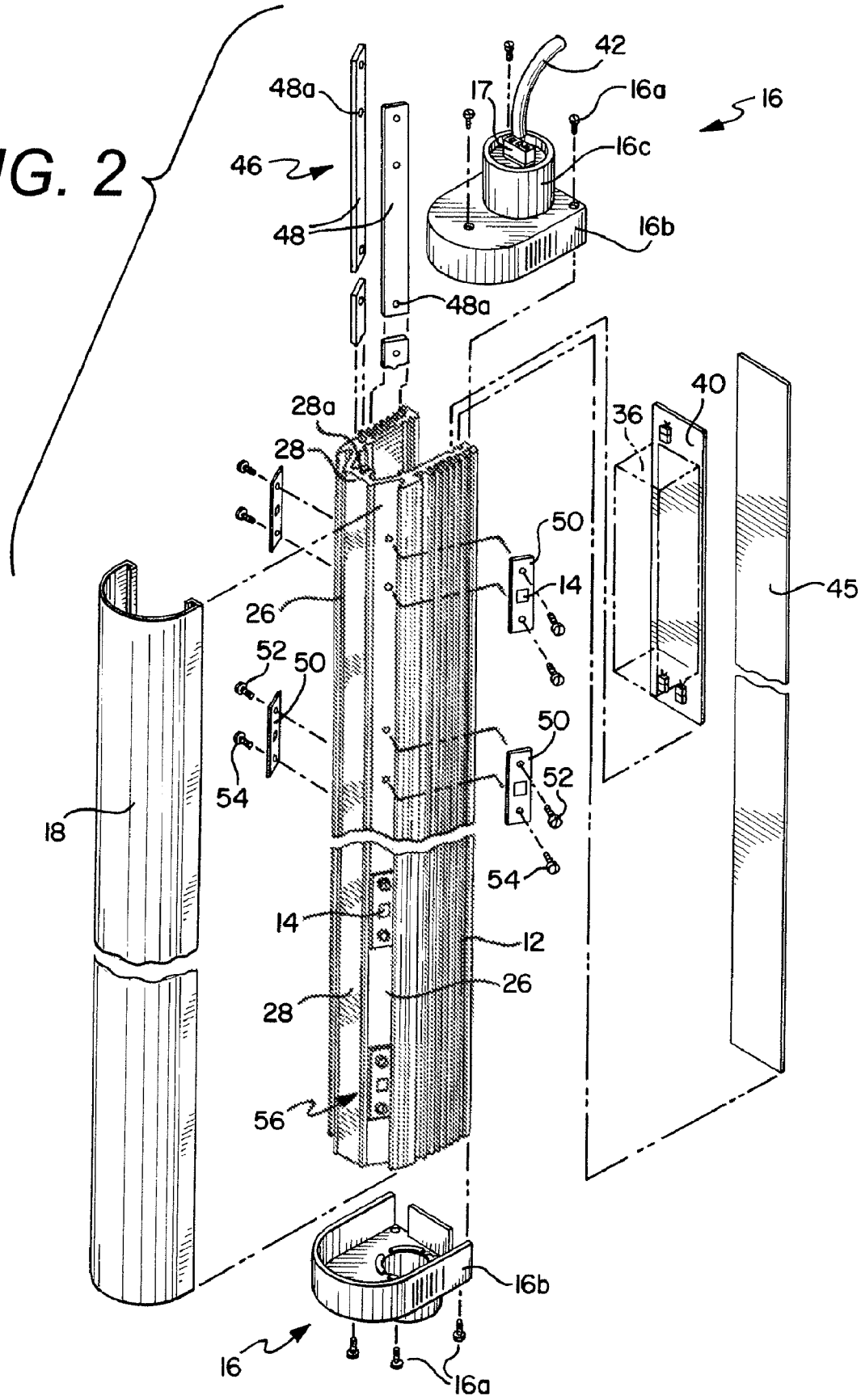
FIG. 2 is an exploded view of the light fixture.
Figure 3:
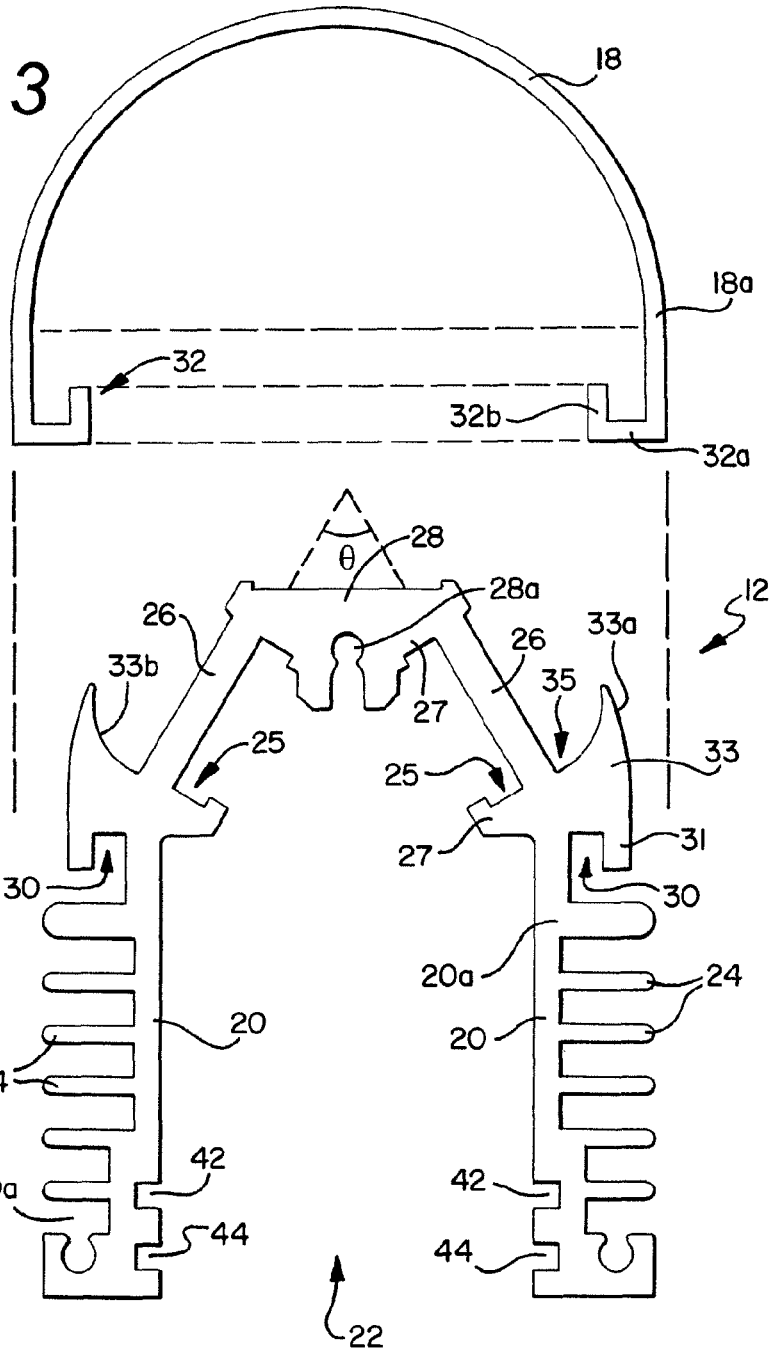
FIG. 3 is an exploded sectional view of a housing of the light fixture, showing a cover above a housing, and a pair of angled support members extending upward to form a peak.

Referring to the sectional views of FIGS. 1-4, the housing 12 includes opposed side walls 20, wherein each side wall 20 includes at least one heat transfer fin 24, and preferably an array of fins 24. An angled support member or rib 26 extends upward from each side wall 20, wherein the support members 26 converge at a substantially horizontal central wall 28, which defines an uppermost portion of the housing 12. Since each support member 26 angularly extends from the respective side wall 20, the central wall 28 is positioned there between. The side walls 20, the support members 26 and the central wall 28 collectively define a central cavity 22 that is generally U-shaped, as shown in FIG. 3. The central wall 28 may be omitted whereby the upper edges of the support members 26 meet to define an edge that extends along the length of the housing 12. Preferably, the housing 12 is a unitary element wherein the side walls 20, the support members 26 and the central wall 28 define a single, integral component. Along those lines, the housing 12 is formed from an aluminum extrusion. Alternatively, the side walls 20, the support members 26 and/or the central wall 28 are separate pieces that are joined, for example by weldment, to form the housing 12. The support members 26 define an internal arrangement angle θ that ranges from 30 to 100 degrees. In the embodiment of FIG. 3, the internal arrangement angle θ is approximately 60 degrees. In another embodiment, the support members 26 are substantially perpendicular to each other, whereby the internal arrangement angle θ is approximately 90 degrees. As explained below, the arrangement angle θ of the support members 26 relates to the angular positioning of the LEDs 14. Described in a different manner, the first support member 26 resides in a first plane and the second support member 26 reside in a second plane, wherein the first and second planes are angled in a manner that corresponds to the internal arrangement angle θ. A vertical center line CL (see FIG. 4) bisects the central wall 28 and separates the housing 12 into two halves. Therefore, the housing 12 is symmetric about the center line CL.

Figure 4:
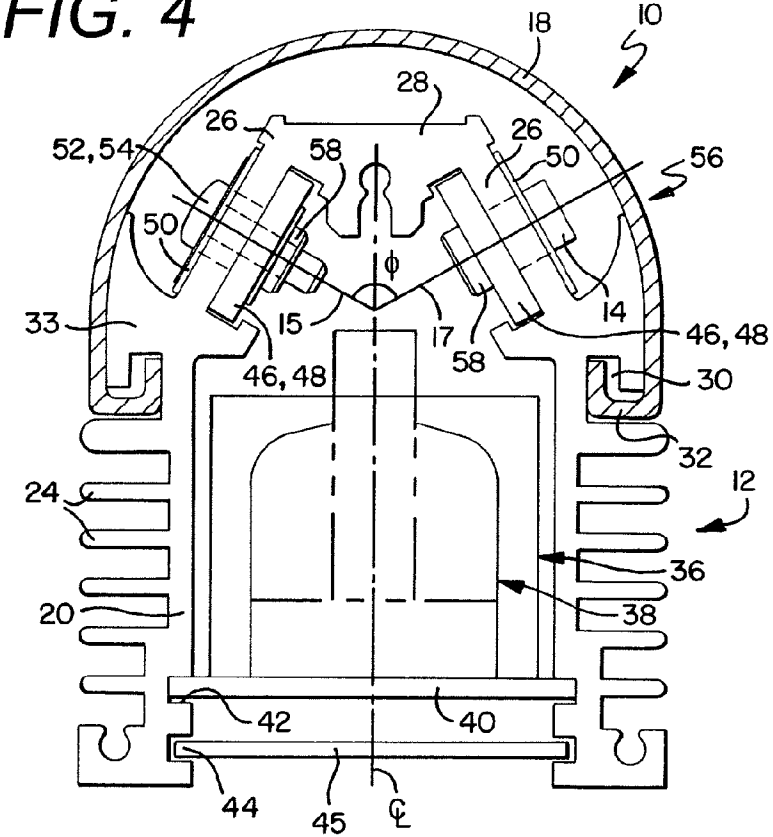
FIG. 4 is a sectional view of the light fixture, showing internal components of the fixture including two LED modules, two interconnection boards and an internal power supply.
Figure 5B:
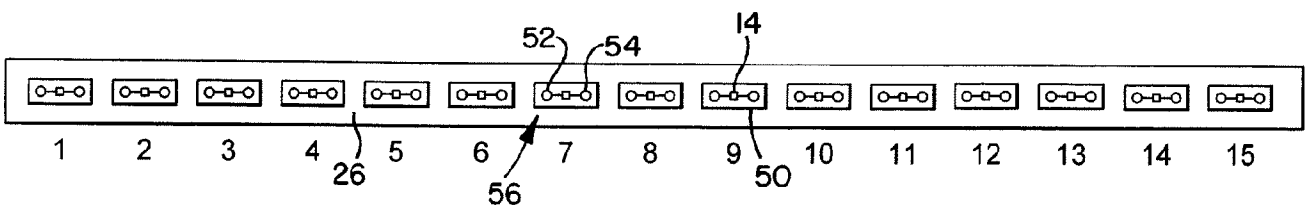
FIG. 5B is a top plan view of fifteen (15) LED modules mounted to a support member of the light fixture.

At an upper end portion, each side wall 20 includes a recess 30 that receives a tongue 32 of the cover 18 for securement of the cover 18 to the housing 12. Preferably, the recess 30 extends longitudinally along the length of the housing 12. The recess 30 is defined between a depending flange 31 and the upper segment 20*a* of the side wall 20. As shown in FIGS. 2-4, the cover 18 is hemispherical in section and the tongue 32 extends inward from a main body portion 18*a* of the cover 18. The tongue 32 has a horizontal component 32*a* and a vertical component 32*b*, wherein the vertical component 32*b* is received within the recess 30. Preferably, the housing 10 is an aluminum extrusion and the cover 18 is U.V. stabilized polycarbonate. A polycarbonate cover 18 provides electrical isolation for the internal components, including the LEDs 14, while allowing most of the light energy produced by the LEDs to pass through the cover 18. The cover 18 may be clear, diffused, or colored depending upon the desired lighting results. In one preferred embodiment, the housing 10 has a length of approximately 60 inches, and the cover 18 is approximately 0.050 inch in thickness. Each side wall 30 further includes a protruding wing or horn 33 positioned above the recess 30, that directs light emitted from the LEDs 14 towards the respective support member 26 (such that light does not travel beyond the cooler/freezer to which the fixture 10 is mounted) and not externally beyond the housing 12. Unlike conventional external reflectors that direct light beyond the fixture housing, the wing 33 functions as a blocking element to reduces glare from the LEDs 14 and obstruct direct viewing of the LEDs 14 mounted to the support members 26. For example, when the fixture 10 is vertically installed in a cooler or freezer, such as those found in grocery stores or convenience stores, the wing 33 blocks emitted light from projecting past the next cooler/freezer mullion and significantly reduces any glare from reaching a shopper walking down the aisle and along the cooler or freezer. As shown in FIG. 3, wing 33 has a convex outer surface 33*a* and a concave inner surface 33*b* that extends from a lowermost edge of the support member 26. A well 35 is defined between the wing 33 and the support member 26. The well 35 and the inner surface 33*b* internally reflect light emitted from the LEDs 14 and do not act as an external light reflector, whereby the well 35 and the inner surface 33*b* do not direct light out of the housing 12. When the cover 18 is installed, the outer surface 33*a* engages a portion of an inner surface of the cover 18 (see FIG. 4). Although the wing 33 is shown as having a pointed top end, the top end can be rounded or planar.

Referring to FIGS. 1 and 2, the end caps 16 are removably affixed to the longitudinal ends of the housing 12 by at least one elongated connector 16*a*, such as a threaded fastener or pin. The central wall 28 includes a receiver 28*a* (see FIG. 3) that receives the uppermost connectors 16*a* for securement of the end cap 16 to the end of the housing 12. The end cap 16 has a flange 16*b* that overlaps an extent of the end portion of the housing 12. Alternatively, the flange 16*b* is omitted and a main body portion 16*d* of the end cap 16 is substantially planar. In the embodiment of FIGS. 1 and 2, each end cap 16 has a projection 16*c* that extends outward from a main body portion of the end cap 16. The projection 16*c* is configured to assist with the installation of the fixture 10, wherein the projection 16*c* is received by a retaining element (not shown) such as a ring or arc. For example, the fixture 10 can be installed in a refrigerator cooler or freezer that includes a curvilinear retaining element that securedly receives the projection 16*c*. A retainer clip 43 (see FIG. 1) that receives or engages an extent of the projection 16 can be utilized to further secure the installation of the fixture 10. One of the projections 16 includes an electrical connectors 17, such as a male plug or female receptacle, for a power lead or cord 42, preferably universal alternating current (AC) input (such as 85-260 Volts, 47-63 Hertz), leading to an internal power supply 36. Alternatively, the electrical connector 17 is omitted and the power cord 42 extends through the projection 16*c* and the end cap 16 whereby the cord 42 is "hard-wired" to the power source 36. In another embodiment, the projections 16*c* are omitted from each end cap 16, wherein one of the end caps 16 includes either an aperture or a connector 17 for the power cord 42 and the other end cap 16 includes a connector 17 such that multiple fixtures 10 can be electrically interconnected without the use of additional external wires or leads. For example, a first fixture 10 includes a first connector 17 for the power cord 42 and a second end cap 16 with a female receptacle 17. A second fixture 10 includes a first end cap 16 with a male plug connector 17 that mates with the female receptacle 17 of the first fixture 10, whereby the first and second fixtures 10 are electrically interconnected for operation. The ability to directly interconnect the fixtures 10 without using separate leads or wires increases the versatility and utility of the fixture 10 since fewer components are necessary.

Referring to FIGS. 2 and 4, the fixture 10 includes at least one power supply 36 positioned within the housing 12. Alternatively, an external power supply can be utilized to power the fixture components. An external power supply is useful when the height of the side wall 20 needs to be reduced to provide a "low-profile" housing 12 due to space constraints of the installation location. The internal power supply 36 reduces installation costs and eliminates additional wiring and external hardware. Preferably, the power supply 36 features universal input which allows the fixture 10 to be used in any electrical grid around the world. The power supply 36 is a high-efficiency unit that provides constant current output (meaning direct current (DC)) in order to uniformly energize the LEDs 14. High-efficiency may be obtained by utilizing a switching type power supply design. The power supply 36 may also have power factor correction capability and built-in electromagnetic interference (EMI) filtering to reduce and/or eliminate noise and distortion from the electrical grid. The fixture 10 may include a single power supply 36 to power both groups of LEDs 14, or a power supply 36 for each group of LEDs 14. The power supply 36 may be an open frame type or an enclosed type with an outer housing or case, where the open frame type may include a coil 38. The power supply 36 is retained within the internal cavity 22 by a mounting element 40 that is received by opposed channels 42 of the housing 10. The mounting element 40 may be a printed circuit board that is part of the power supply sub-assembly, such as with open frame types, or may be a plate to which an enclosed power supply 36 is mounted. Alternatively, the power supply 36 may be mounted directly to the rear cover plate 45. A dielectric insulating material may be placed between the power supply 36 and the rear cover plate 45 to function as a barrier to high voltage circuits. As explained below, the power supply 36 provides constant current levels through an interconnection board assembly 46 to the LEDs 14 mounted to each support member 26. A pair of connector wires 62, 64 extend between the power supply 36 and each interconnection board assembly 46.

Figure 3A:
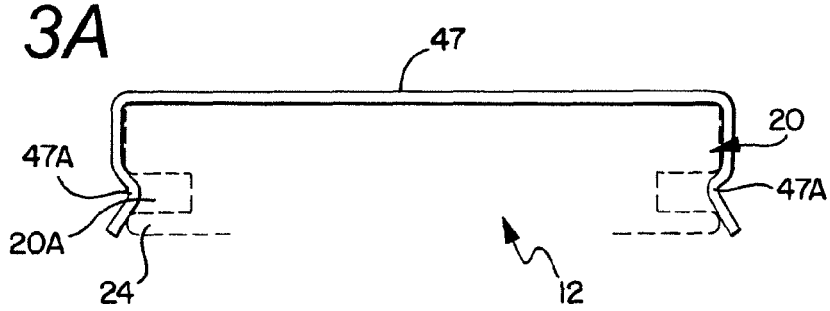
FIG. 3A is a plan view of a mounting bracket attached to the housing of the light fixture.

To enclose the housing 10, a rear cover plate 45 that functions as a barrier to high voltage circuits and connections is received within lowermost opposed channels 44. The rear plate 45 can be configured such that it is slidingly received within the channels 44 to expedite assembly of the FIG. 10. Alternatively, the cover plate 45 is integrally formed with the side walls 20 wherein the housing 12 is a unitary structure. Also, the cover plate 45 may be fabricated with mounting brackets, such as mechanical clips, to obviate the need for additional mounting hardware. Thus, the cover plate 45 allows for different mounting profiles and interface connections, thereby increasing the utility of the fixture 10. In another alternative shown in FIG. 3A, an external bracket 47 engages a groove 20*a* in a lower portion of each housing side wall 20. The bracket 47 includes opposed projections 47*a* that are received within the groove 20*a* for positive engagement. The bracket 47 can be secured to a horizontal, vertical or angled surface to allow for a variety of fixture 10 mounting configurations. For example, the bracket 47 can be secured to a ceiling whereby the fixture 10 is an overhead horizontal fixture that provides light from above one's head.

The fixture 10 includes two groups of multiple LEDs 14, wherein a first group of LEDs 14 is mounted to one of the support members 26 and a second group of LEDs 14 is mounted to the other support member 26. Because the support members 26 are angularly positioned, the grouping of LEDs 14 connected to the support members 26 are also angled from each other. Described in a different manner, and in contrast to conventional fixtures, the first group or array of LEDs 14 is angularly positioned with respect to the second group or array of LEDs 14, which enhances the range of light distribution without the need for reflective surfaces or additional lenses within the fixture 10. Preferably, the LEDs 14 are oriented substantially perpendicular to the support member 26, wherein a longitudinal axis 15 of the left LED 14 (representing the first group of LEDs) is substantially perpendicular to the respective support member 26 and a longitudinal axis 17 of the right LED 14 (representing the second group of LEDs) is substantially perpendicular to the respective support member 26. Each group of LEDs 14 extend along the length of the support member 26, and thus the length of the fixture 10. When the fixture 10 is vertically oriented as in FIG. 1, the LEDs 14 of one group may be horizontally aligned with the LEDs 14 of the second group, or horizontally misaligned such that a continuous line connecting the LEDs 14 of both groups is staggered. The longitudinal axis 15 of the left LED 14 (representing the first group of LEDs) intersects the longitudinal axis 17 of the right LED 14 (representing the second group of LEDs) to define a LED intersection angle $\Phi$. The LED intersection angle $\Phi$ is a function of the support member internal arrangement angle $\theta$, where the sum of the LED intersection angle $\Phi$ and the internal arrangement angle $\theta$ equals 180 degrees. In the embodiment of FIGS. 3 and 4, where the support member internal arrangement angle $\theta$ is approximately 60 degrees, the LED intersection angle $\Phi$ is approximately 120 degrees. Due to the angular positioning of the LEDs 14 and the wings 33, the fixture 10 provides a light range of approximately 180 degrees, without the use of a reflector or reflecting surfaces. In the event the wings 33 are removed, the fixture 10 provides a light range of approximately 240 degrees.

Figure 5A:
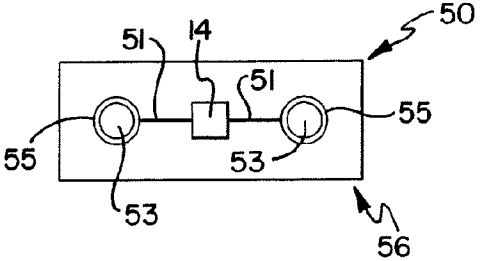
FIG. 5A is a top plan view of a LED module circuit board of the light fixture.
Figure 5C:
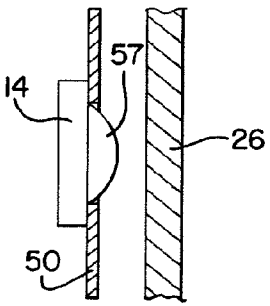
FIG. 5C is an exploded schematic view of a printed circuit board of the light fixture, showing the circuit board positioned above a support member and an interface element positioned within an aperture of the circuit board and in thermal contact with a lower surface of a LED.

Referring to FIGS. 1, 2, 4, 5A and B, each LED 14 is surface mounted to a printed circuit board (PCB) 50 that is removably affixed to the support member 26 by a first electrically conductive fastener 52 and a second electrically conductive fastener 54. The LED 14 is surface mounted between the first and second fasteners 52, 54, which are preferably elongated metal screws or pins. The board 50 includes a copper trace 51 between the first fastener 52 and the LED 14, and a second copper trace pattern 51, the LED 14 and the second fastener 54. As shown in FIG. 5A, the PCB 50 includes a pair of apertures 53, each one sized to receive an extent of each fastener 52, 54. Preferably, the PCB 50 includes a copper trace ring 55 about each aperture 53 and electrically connected to the copper trace 51. The copper trace ring 55 functions as an electrical interface between an upper portion of the fastener 52, 54, such as the head of a screw, and the LED 14. Thus, the copper traces 51 and the copper trace ring 55 define a trace pattern that facilitates electrical connectivity across the PCB 50 and its components. A nylon bushing (not shown) may be positioned around an extent of the shaft of the fastener 52, 54 to function as an electrical insulator.

The LED 14, the PCB 50, the copper trace 51, 53 and the fasteners 52, 54 collectively define a LED module 56. Within each module 56, current flows from the first fastener 52 along the first copper trace 51, 53 to the LED 14, across the LED 14, and then along the second copper trace 51, 53 through the second fastener 54, and then to a subsequent LED module 56, via the interconnection board assembly 46. Although the module 56 is shown as having a single LED 14, a number of LEDs 14 can also be positioned between the first and second fasteners 52, 54. For example, the module 56 can have a first and a second LED 14 positioned between the first and second fasteners 52, 54, wherein a first copper trace 51 extends between the first fastener 52 and the first LED 14, a second copper trace 53 extends between the first and second LEDs 14, and a third copper trace 51, 53 extends between the second LED 14 and the second fastener 54. If an LED 14 fails or upgrades are desired, the fasteners 52, 54 can easily be removed to allow for the removal of the old LED module 56 and installation of a replacement and/or upgraded LED module 56. In one embodiment, the board 50 has a length of roughly 1.5 inches and a width of roughly 0.5 inch, and the LEDs 14 are warm white producing at least 30 Lumens (SI unit of luminous flux) per watt and with a color temperature ranging between 2,750 to 6,500 K and high color rendering index (CRI) of greater than 80. The CRI represents how a light source makes the color of an object appear to human eyes and how well subtle variations in color shades are revealed. The CRI is a scale from 0 to 100 percent indicating how accurate a "given" light source is at rendering color when compared to a "reference" light source, where the higher the CRI, the better the color rendering ability. In one embodiment, the fixture 10 includes fifteen (15) separate LED modules 56 positioned along each support member 26. One of skill in the art of LED fixture design recognizes that the number of LED modules 56 varies with the design parameters of the housing 12 and the support member 26. For example, a fixture 10 having a length of approximately 30 inches would have roughly one-half as many modules 56 mounted to each support structure.

The PCB 50 may be aluminum-clad or constructed from fiberglass. In the former construction, the aluminum-clad PCB 50 provides a thermal conductive path for heat generated by the LED 14 through the support member 26 to the side wall 20 and the fins 24 for dissipation. In the latter construction where the PCB 50 is fiberglass (FR4), a thermally conductive interface element 57 (see FIG. 5C) is provided near the LED 14 to facilitate heat transfer to the support member 26 since fiberglass does not provide a thermal conductive path. Accordingly, a hole or aperture is formed in the fiberglass PCB 50 below the LED's 14 thermal slug to accommodate the interface element 57, which is in thermal contact with the LED 14 to facilitate heat transfer from an energized LED 14 to the support member 26. Described in a different manner, the interface element 57 fills the void below the LED 14 and in the region created by the hole in the PCB 50 when the module 56 is connected to the support member 26. In general terms, the interface element 57 is thermally conductive but electrically insulating. Further, the interface element 57 is highly conformable and exerts a minimal amount of external stress upon the surrounding components, including the LED 14. During operation, heat generated by the LED 14 is transferred by the interface element 57 through the PCB 50 to the support member 26 and then to the side wall 20 and the fins 24 for dissipation. In one embodiment, the interface element 57 is a generally circular pad formed from a low viscosity, non-electrically conductive gel or resin with high thermal conductivity and low thermal resistance properties. In the pad configuration, the interface element 57 has a thickness greater than that of the PCB 50 before compression/installation of the components, and has a lesser thickness upon installation that corresponds to the thickness of the PCB 50. In another embodiment, the interface element 57 is a thermally conductive liquid filler that is deformed to fill the void between the LED 14 and the support member 26 to which the module 56 is mounted. In either embodiment, the interface element 57 does not exert measurable stress or force upon the LED 14. In another embodiment, the fiberglass PCB 50 includes a number of plated thru holes which reside under the LED 14 thermal slug, thereby acting as "thermal vias" to transfer heat through the PCB 50. A thermal interface material is placed between the PCB 50 and the support member 26, which facilitates heat transfer from the lower portion of the PCB 50 to the support member 26, and also acts as an electrical insulator. This thermal interface material can be a die cut thermal pad, preferably round in shape, and large enough to cover or overlap the thermal vias in the PCB 50.

The interconnection board assembly 46 is an electrically conductive bus comprised of numerous printed circuit boards 48 positioned within a channel 25 adjacent an inner surface of the angled support member 26. The channel 25 is formed by upper and lower protrusions 27 that extend inward from the support member 26, and extends along the length of the member 26. Preferably, the individual interconnection boards 48 are slidingly inserted into the channel 25. As explained below, adjacent interconnection boards 48 are electrically interconnected to form the board assembly 46. Referring to FIG. 4, the interconnection boards 48 are secured in place by the fasteners 52, 54, which extend through an opening in the support member 26, an opening 48*a* in the board 48, and a metallic nut 58. A lower extent of the fastener 52, 54 may extend past the board 48 and the nut 58. Accordingly, the fasteners 52, 54 provide two functions: mechanical connection of the LED modules 56 and the interconnection boards 48 to the support member 26, and electrical connection of the interconnection boards 48 to the LED modules 56. To the extent that the fasteners 52, 54 are heated during operation of the modules 56, the fasteners 52, 54 are thermally conductive to transfer an amount of heat away from the LED 14 and generally towards the interconnect board 48 to which the fasteners 52, 54 are coupled.

In FIG. 4, the section line for the left module 56 shows the fastener 52, 54, while the section line for the right module 56 shows the LED 14 and the nut 58. Therefore, the interconnection board assembly 46 and the LED modules 56 are stacked about or "sandwich" the support member 26. The interconnection board assembly 46, including the individual boards 48, are energized by the power supply 36, and provide electrical potential through its length to each LED module 56 electrically and mechanically connected thereto. Furthermore, each interconnection board 48 includes copper traces 49 to facilitate current flow between the fasteners 52, 54 and the nuts 58. In addition to providing electrical potential to the LED modules 56, the interconnection board assembly 46 functions as an anchor point for the connection of the LED modules 56 to the support member 26. Significantly, if a LED 14 malfunctions or fails, the fasteners 52, 54 can be removed to allow for replacement of the affected module 56 without necessitating the replacement of the support member 56 or the power supply 36. The same holds true for improvements in LED technology, where an old LED module 56 can be replaced by an upgraded LED module 56 by simply removing the fasteners 52, 54. The ease in upgrading the fixture 10 allows for the most advanced LED technology to be installed at suitable intervals while preventing the fixture 10 from becoming obsolete. This attribute enables the fixture 10 to retain significant value over time, and extends the utility of the fixture 10 for upgrades and service life.

Figure 6:
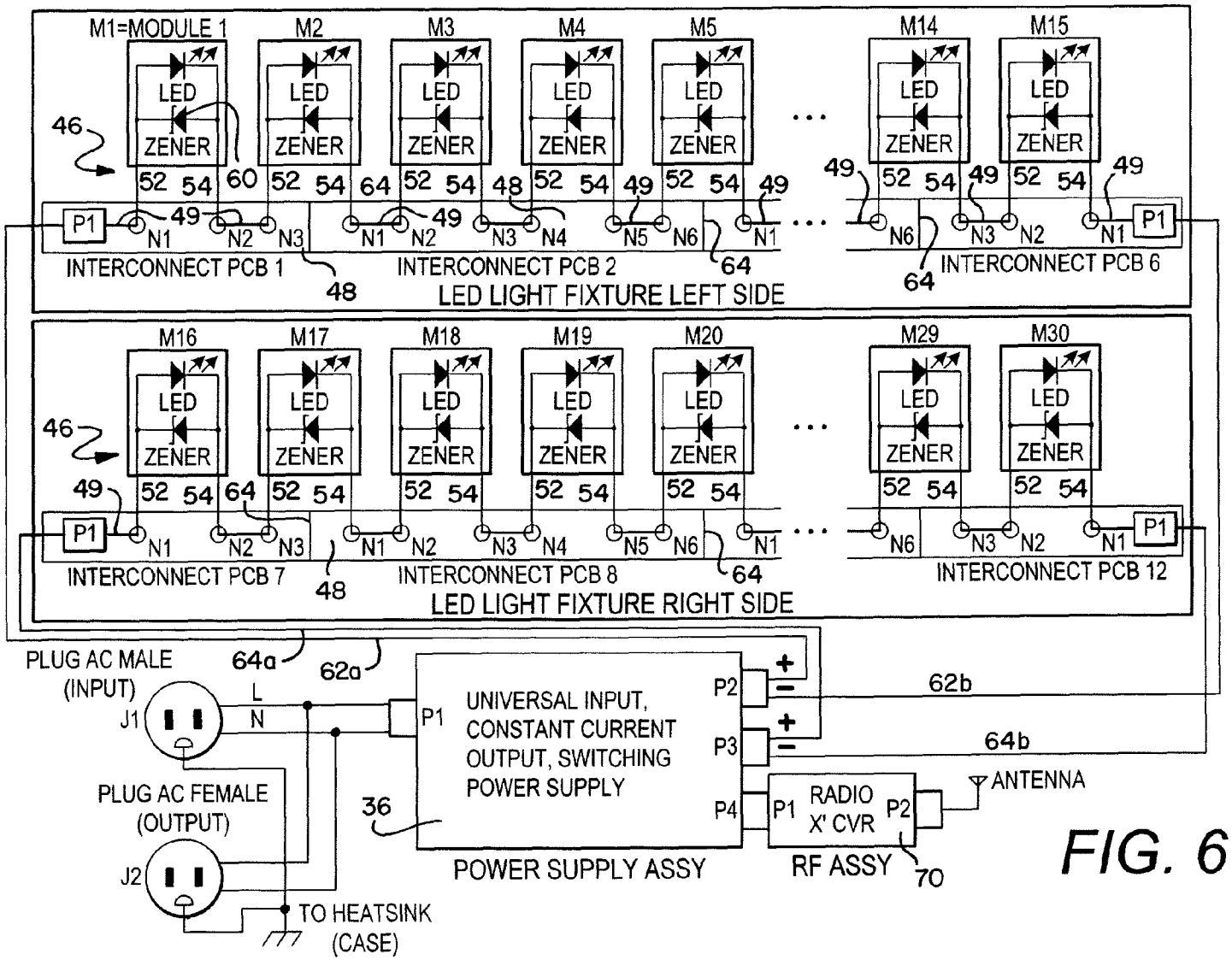
FIG. 6 is an electrical schematic of the light fixture, showing a power supply assembly, radio frequency components for wireless operation, and a pair of interconnection board assemblies with LED modules electrically connected to the board assemblies.
Figure 7:
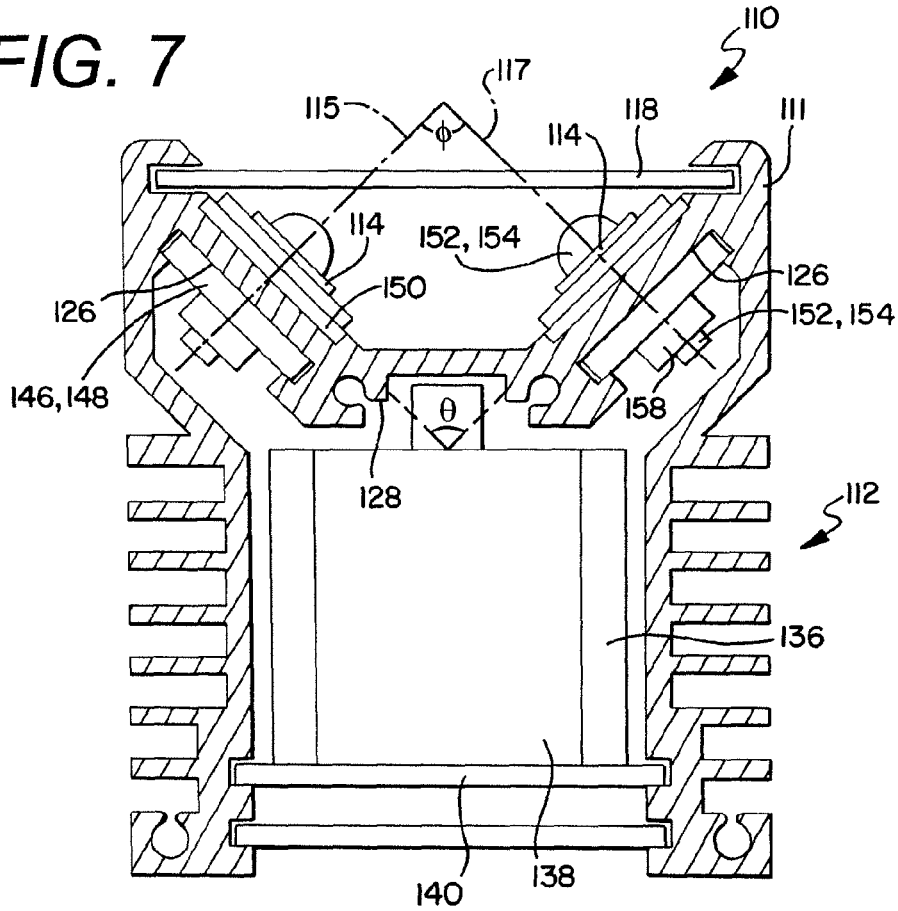
FIG. 7 is a sectional view of a housing of an alternate light fixture, showing a pair of angled support members extending downward to form a valley within the housing.

Referring to the schematic of FIG. 6, a preferred embodiment of the fixture 10 is diagrammed. In this embodiment of the fixture 10, there are fifteen (15) LED modules 56 electrically and mechanically coupled to each support member 26 (depicted as a rectangular box) and interconnection board assembly 46, the latter of which comprises six (6) interconnection boards 48. As explained in greater detail below, each module 56 includes a zener diode 60 associated with the LED 14 resulting in "bypass" circuitry to prevent catastrophic failure of the fixture 10. Other embodiments of the fixture 10 do not include the zener diode 60. A pair of connector wires 62, 64 extend between the power supply 36 and two interconnection board assemblies 46, where one of the board assemblies 46 is affixed to the right side of the fixture 10 at the support member 26 and the other board assemblies 46 is affixed to the left side of the fixture 10 at the other support member 26. The positive wire 62*a* leads to right interconnection board assembly 46 and the positive wire 64*a* leads to the left interconnection board assemblies 46. The positive wire 62*a* is electrically connected to the first interconnection board 48, designated PCB 1, of the left interconnection assembly 46 at a single connection point, P1. A copper trace extends between the connection point P1 and a first nut 58, designated N1, of the first interconnection board 48 PCB 1. In a similar manner, the positive wire 64*a* is electrically connected by a copper trace 49 to a first nut 58, designated N1, of the seventh interconnection board 48, designated PCB 7, of the right interconnection assembly 46.

The structure and sequence of the left side of the fixture 10, including the left interconnection board assembly 46, is provided. Current flows from the first nut 58 N1 to the components of the first module 56, designated Module 1 or M1, via the first fastener 52 (which is represented by a first vertical line). Current flows through the components of the first module 56 M1 and illuminates the LED 14 therein. Current exits the first module 56 M1 along the second fastener 54 (represented by a second vertical line) to a second nut 58, designated N2. A copper trace extends between the second nut 58 N2 and a third nut 58, designated N3, associated with the first interconnection board 48 PCB 1. Current then exits the first interconnection board 48 PCB 1 via a first fastener 52 that extends between the third nut 58 N3 and the second module 56, designated Module 2 or M2. Current flows through the components of the second module 56 M2 and illuminates the LED 14 therein. The trailing end of the first interconnection board 48 PCB 1 and the leading end of a second interconnection board 48, designated PCB 2, form a seam 64 positioned below the second module 56 M2. Current exits the second module 56 M2 along the second fastener 54 to a first nut 58, designated N1, of the second interconnection board 48. A copper trace 49 extends between the first nut 58 N1 and a second nut 58, designated N2. Current then exits the second interconnection board 48 PCB 2 via a first fastener 52 that extends between the second nut 58 N2 and the third module 56, designated Module 3 or M3. Current flows through the components of the third module 56 M3 and illuminates the LED 14 therein. Current exits the third module 56 M3 along the second fastener 54 to a third nut 58, designated N3, of the second interconnection board 48. This sequence continues within the fourth module 56 M4 and the fifth module 56 M5. Current exits the fifth module 56 M5 along the second fastener 54 to a first nut 58, designated N1, of the third interconnection board 48 PCB 3. As a result, the seam 64 is formed between the second interconnection board 48 PCB 2 and the third interconnection board 48 PCB 3, and that seam 64 resides under the fifth module 56 M5. The structure of the interconnection board assembly 46 continues in a similar manner across the fifth through fifteenth modules 56 M5-M15. Current exits the fifteenth module 56 M15 along the second fastener 54 to a first nut 58, designated N1, of the sixth interconnection board 48 PCB 6. Negative wire 62*b* is connected to the sixth interconnection board 48 PCB 6 at a single point P1, and completes the circuit between the power supply 36 and the interconnection board assembly 46. The structure and sequence for the right side of the fixture 10, including that for the seventh through twelfth interconnect boards 48 PCB 7-12 and the LED modules 56 M16-M30, is similar to that explained above for the left side of the fixture 10.

As evidenced by FIGS. 1-6, the fixture 10 includes a number of unique aspects. First, there is a single point connection between the power supply 36 and each of the interconnection board assemblies 46. Also, multiple LED modules 56 are electrically connected to a single interconnection board 48. Next, multiple interconnection board 48 form the interconnection assembly 46 that extends the length of the combined LED modules 56 and substantially the length of the fixture 10. Nuts 58, fasteners 52, 54 and copper traces 49 are utilized to electrically connect the various components, thereby eliminating the need for additional wires and connectors that increase the assembly time and build cost of the fixture 10. Furthermore, the two groups of LED modules 56 that are mounted on different planes provide a broader range of light than that provided by conventional fixtures having LEDs arranged in a single plane.

As briefly mentioned above and as shown in FIG. 6, when the LED modules 56 are serially arrayed, each module 56 can include a zener diode 60 electrically connected to the LED 14 by a copper trace. In the event the module 56 includes multiple LEDs 14, then a zener diode 60 is electrically connected to each LED 14. The zener diode 60 and the LED 14 combine to form a "bypass" circuit to prevent catastrophic failure of the fixture 10. The zener diode 60 provides an alternate electrical path, where the diode 60 provides high resistance (essentially an open-circuit) to voltage and current transmission when the LED 14 is operating normally. In the event the LED 14 malfunctions or fails, the zener diode 60 provides an alternate current path to complete the circuit for that particular module 56 and the remaining LED modules 56 in the fixture 10. In this situation, the voltage drop across the diode 60 is similar to the voltage drop across a properly operating LED 14. Although the diode 60 has no illumination characteristics, it provides an alternate or bypass electrical path to allow the other LED modules 56 to remain operational. For example, the fixture 10 has fifteen LED modules 56, each having a zener diode 60 associated with a LED 14. Assuming the LED 14 in the third module 56 fails, current continues to flow in the bypass path provided by the zener diode 60 and only that particular LED 14 will not be illuminated and the remaining modules 56—numbers one, two and four through fifteen—will continue to operate with their respective LED 14 being illuminated. In this manner, the failure of one LED 14 will only affect that particular module 56 and the remaining modules 56 in the group or string will continue to operate as intended. Without the bypass provided by the zener diode 60, an entire array or string of LEDs will lose illumination when just one LED therein fails or malfunctions. In addition to bypass operation, the zener diode 60 helps service technicians to identify a faulty LED module 56, since only that module 56 will be dark while the other modules 56 are illuminated. In this manner, replacement and/or upgrade of the modules 56 is made more efficient and less time consuming.

In the embodiment of FIG. 6, the fixture 10 includes a wireless module, primarily a radio frequency control unit 70, that enables the operation of the fixture 10 to be remotely controlled. The radio frequency control unit 70 can be factory assembled into the fixture 10 as original equipment, or added to the fixture 10 in the field by a service technician. In general terms, the radio frequency control unit 70 allows an operator to remotely turn on, turn off, or adjust the fixture 10 or group of fixtures 10 to any desired brightness level. The remote interaction resulting from the control unit 70 provides a number of benefits to the fixtures 10, including longer operating life for the components, lower energy consumption, and lower operating costs.

In a store or building having multiple fixtures 10, each fixture 10 may be assigned a radio frequency (RF) address or identifier, or a group of fixtures 10 are assigned the same RF address. An operator interfacing with a lighting control network can then utilize the RF address to selectively control the operation and/or lighting characteristics of all fixtures 10, a group of fixtures 10, or individual fixtures 10 within the store. For example, all fixtures 10 having an RF address corresponding to a specific function or location within the store, such as the deli coolers in a grocery store, can be dimmed or turned off when the store is closed for the evening. The operator can be located within the store and utilize a hand held remote to control the group of fixtures 10 and/or individual fixtures 10. Alternatively, the operator may utilize a personal digital assistant (PDA) or a computer to control the fixtures 10. In a broader context where stores are located across a broad geographic region, for example across a number of states or a country, the fixtures 10 in all stores may be linked to a lighting network. A network operator can then utilize the RF address to control: (a) all fixtures 10 linked to the network; (b) the fixtures 10 on a store-by-store basis; and/or (c) groups of fixtures 10 within a store or collection of stores based upon the lighting function of the fixtures 10, including those used in coolers, refrigerated displays, and freezers.

The radio frequency control unit 70 comprises a printed circuit board that contains a transceiver (receiver and transmitter), a power supply, an antenna, and control interface for the power supply 36. The control interface includes a connector containing input signals for providing raw power to the control unit 70, as well as output signals for controlling the power supply 36 itself. In operation, the control unit 70 interacts with the power supply 36 to allow an operator to power on, power off, or dim the brightness of the fixture 10. To ensure reception of the operating signals, the control unit 70 has an embedded antenna, or an external antenna mounted under the cover 18 for better wireless reception. The radio frequency control unit 70 can receive commands from a centralized controller, such as that provided by a local network, or from another control module 70 positioned in a fixture 10 in close proximity. Thus, the range of the lighting network could be extended via the relaying and/or repeating of control commands between control units 70.

A centralized lighting controller that operably controls the fixtures 10 via the control units 70, can be configured to interface with an existing building control system or lighting control system. The central lighting controller may already be part of an existing building control system or lighting control system, wherein the fixture 10 and the control unit 70 are added as upgrades. The radio frequency control unit 70 could utilize a proprietary networking protocol, or use a standard networking control protocol. For example, standard communication protocols include Zigbee, Bluetooth, IEEE 802.11, Lonworks, and Backnet protocols.

Networked lighting controls, either radio frequency or hardwired, can be easily integrated into newly constructed devices such as refrigeration or freezer display cases when they are manufactured, due to economies, access, and technology in the manufacturing and assembly processes. It is impractical, economically, to integrate networked lighting controls, either RF or hardwired, into existing refrigeration or freezer display cases. Most existing refrigeration or freezer cases have only AC power connected to the units. Separate lighting controls could possibly be added to existing units, however, the complexity of retrofit, cost of installation, and limited functionality would be a deterrent. By embedding or integrating the radio frequency control unit 70 directly into the fixture 10, the prohibitive costs of upgrading lighting systems in the field can be eliminated.

In another embodiment, the fixture 10 includes three groups of multiple LEDs 14, wherein a first group of LEDs 14 is mounted to one of the support members 26, a second group of LEDs 14 is mounted to the other support member 26, a third or central group of LEDs is mounted to the central wall 28 (not shown). Both support members 26 and the central wall 28 are angularly positioned to each other as explained above. Because the support members 26 are angularly positioned, the grouping of LEDs 14 connected to the support members 26 are also angled from each other. The longitudinal axis 15 of the left LED 14 (representing the first group of LEDs) intersects a longitudinal axis of the central LED 14 (representing the centralized LEDs) to define a first LED intersection angle Φ, and the longitudinal axis of the central LED 14 intersects the longitudinal axis 17 of the right LED 14 (representing the second group of LEDs) to define a second LED intersection angle Φ. Consistent with that explained above, each LED 14 of the first, second and central groups is surface mounted to a printed circuit board (PCB) 50 that is removably affixed to the support member 26 or central wall 28 by a first electrically conductive fastener 52 and a second electrically conductive fastener 54. In addition to the two interconnection board assemblies 46 positioned below the first and second LED groups, a third interconnection board assembly 46 is positioned within a channel (not shown) adjacent an inner surface of the central wall 28. The third interconnection board assembly 46 has similar structural and operational characteristics to the first and second board assembly 46 explained above. In this configuration of the fixture 10, light is provided by LEDs 14 arrayed in three distinct planes.

Due to the upwardly extending support members 26, the upper portion of the housing 10 of FIGS. 1-4 has a "peak" configuration. In another embodiment of the fixture 110 shown in FIG. 7, the housing 112 has support members 126 that extend downward and inward at an angle to form an upper recess or "valley" within the housing 110. The support members 126 depend approximately 45 degrees from an upper edge 111 of the housing 110 and connect with the central wall 128, whereby the central wall 128 resides below the LEDs 114 and the PCBs 150. As shown in the Figure, the sloped support members 126 define an internal arrangement angle θ that is approximately 90 degrees. Two groups of LED's 114 are mounted to the support members 126 as explained above. However, a longitudinal axis 115 of the left LED 114 (representing the first group of LEDs) intersects a longitudinal axis 117 of the right LED 114 (representing the second group of LEDs) to define a LED intersection angle Φ of approximately 90 degrees. Due to the depending support members 126, the central wall 128 resides substantially below the LEDs 14 and/or the module 150. The dimensions of the central wall 128 vary with the length and/or angular orientation of the support members 126. For example, the width of the central wall 128 is reduced when the support members 126 are wider such that they depend further into the housing 110. In contrast, the width of the central wall 128 is increased when the support members 126 depend from the housing upper edge 11 at a lesser angle than 45 degrees.

Figure 8:
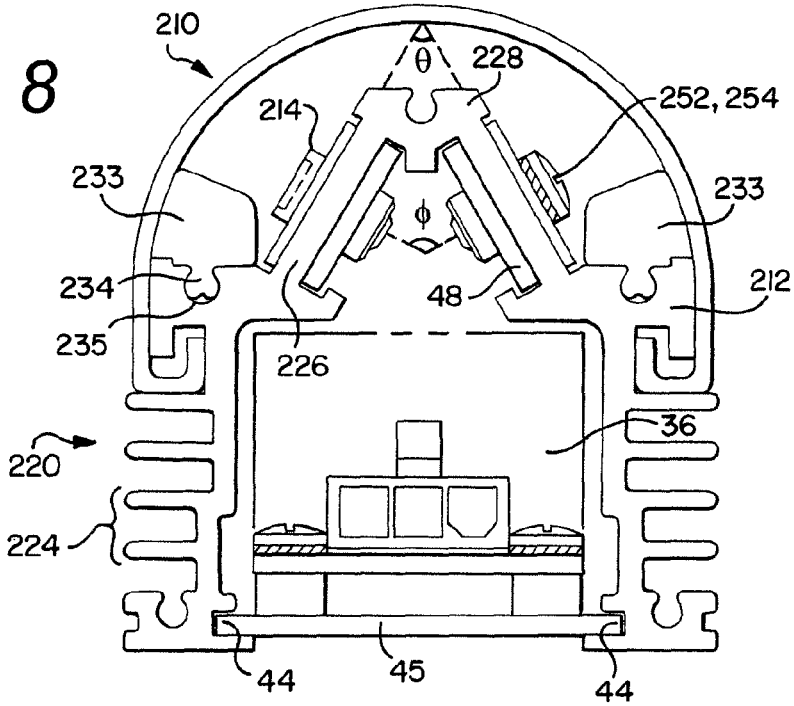
FIG. 8 is a sectional view of an alternate light fixture, showing the fixture having wings extending from the housing and adjacent the cover; and, FIG. 9 is an exploded view of the light fixture of FIG. 8.
Figure 9:
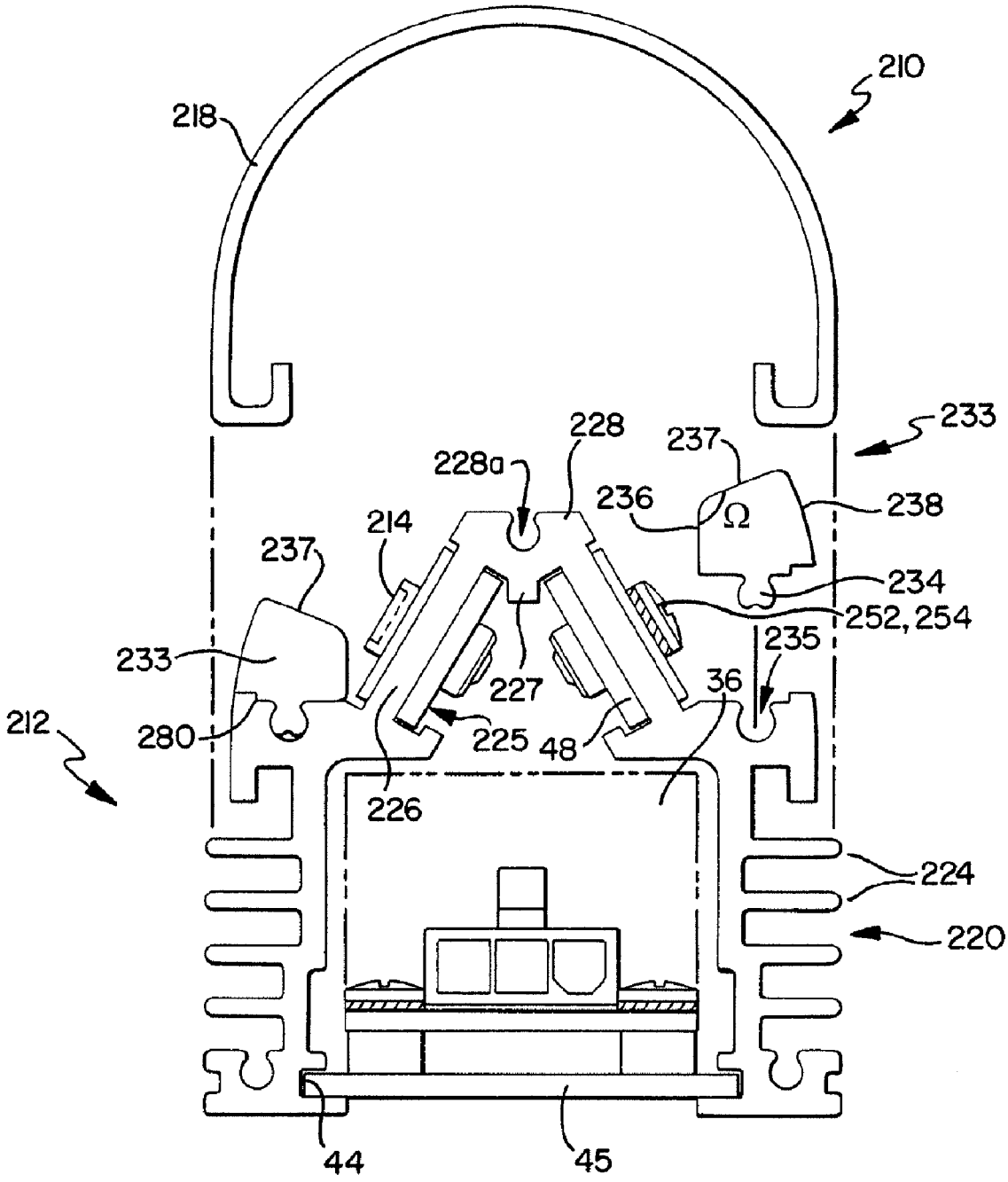

In another embodiment shown in FIGS. 8 and 9, the fixture 210 includes a wing 233 removably connected to the housing 212, preferably above the side wall 220. The wing 233 includes one of either a projection 234 or a receiver 235, and the housing 212 includes the other of the receiver 235 or the projection 234. In the embodiment of FIG. 8, the wing 233 includes a depending, curvilinear projection 234 and the housing 212 includes a curvilinear receiver 235 that is positioned over both the fins 224 and an upper segment of the side wall 220. In this manner, the projections 234 is slidingly received by the receiver 235 to couple the wing 233 to the housing 212. The wing 233 has upwardly extending inner wall 236 and an inclined upper wall 237, and an outer wall 238 positioned adjacent an inner surface of the cover 218. The wing 233 has a staggered lower edge 239 and the housing 212 has a staggered upper edge 213 wherein a notch 280 is formed there between. As mentioned above, the wing 233 functions as a blocking element, not an external reflector, to reduces glare and obstruct direct viewing of the LEDs 214. Along those lines, the inner wall 236 extends upward beyond the lower edge of the fasteners 252, 254 and the lower edge of the LED 214. Also, the inclined upper wall 237 is positioned above the lower edge of the fasteners 252, 254 and the lower edge of the LED 214. However, the inclined upper wall 237 terminates at the outer wall 238 below the upper edge of the fasteners 252, 254 and the upper edge of the LED 214. Referring to FIG. 9, the inner wall 236 intersects the upper wall 237 to define a wing intersection angle Ω that ranges between 100-130 degrees, and preferably 110-115 degrees. Based upon the wing intersection angle Ω, the upper wall 237 directs any light from the LED 214 towards the support member 226 and not external to the housing 212. To facilitate LED glare reduction, the wing 233 may be coated with a non-reflective exterior layer and may be fabricated from plastic, such as ABS plastic, or aluminum. In contrast to the housing 12 of FIGS. 1-3, the central wall 228 includes an externally oriented receiver 228*a* (see FIG. 9) that receives the connector 16*a* for securement of the end cap 16 (the receiver 28*a* of FIG. 3 is internally oriented). Further, there is one central, depending protrusion 227 that defines the upper boundary of the channel 225 that extends the length of the member 226 and that receives the interconnection boards 48. The support members 226 provide the internal arrangement angle θ that is approximately 60 degrees. The LED intersection angle Φ is approximately 130 degrees.

While the specific embodiments have been illustrated and described, numerous modifications come to mind without significantly departing from the spirit of the invention, and the scope of protection is only limited by the scope of the accompanying Claims.

What is claimed is:

1. A lighting fixture for use in refrigerator coolers or freezers, the lighting fixture comprising:

an elongated external housing securable to an interior of a refrigerated cooler or freezer, the external housing having a first external side wall and a second external side wall wherein each external side wall has at least one heat dissipating fin extending from an external surface of said external side wall, the housing further having a first support member angularly and integrally extending from the first external side wall and a second support member angularly and integrally extending from the second external side wall, wherein the support members terminate at an elevated central wall, and wherein the first and second external side walls, the first and second support members, and the central wall collectively define a U-shaped internal cavity of the housing with an open end configuration opposite the central wall, and wherein the U-shaped internal cavity is enclosed by a removable rear wall extending between a lowermost portion of the first and second external side walls;

a first group of light modules secured to the first support member by a first elongated fastener and a second elongated fastener, each light module comprising a light emitting diode (LED) mounted on a printed circuit board, wherein said elongated fasteners extend through printed circuit board and into the first support member; and, a second group of light modules secured to the second support member by a first elongated fastener and a second elongated fastener, each light module comprising a LED mounted on a printed circuit board, wherein said elongated fasteners extend through printed circuit board and into the second support member.

2. The lighting fixture of claim 1, further comprising a power supply that resides within the internal cavity of the housing and wherein the power supply is a high-efficiency power supply that provides constant current output.

3. The lighting fixture of claim 1, wherein the printed circuit board of each group of light modules is removably secured to an outer surface of a respective support member.

4. The lighting fixture of claim 1, wherein each light module includes a first copper trace on the printed circuit board extending between the first fastener and the LED, and a second copper trace extending between the second fastener and the LED.

5. The lighting fixture of claim 1, further comprising:

a first interconnection board assembly affixed to an inner surface of the first support member beneath the first group of light modules by the first and second fasteners;

a second interconnection board assembly affixed to an inner surface of the second support member beneath the second group of light modules by the first and second fasteners;

wherein each of the first and second interconnection board assemblies comprise a plurality of electrically interconnected printed circuit boards.

6. The lighting fixture of claim 5, wherein the first and second fasteners extend into the printed circuit boards that comprise the interconnection board assemblies.

7. The lighting fixture of claim 5, wherein the interconnection board assemblies are inserted into a channel formed adjacent the inner surface of the support member.

8. The lighting fixture of claim 1, wherein the housing includes a pair of end caps, each end cap coupled to an end of the housing by a fastener extending into the central wall of the housing.

9. The lighting fixture of claim 1, wherein the first and second support members define an internal arrangement angle that ranges between 30 and 100 degrees.

10. The lighting fixture of claim 1, wherein a longitudinal axis of one LED in the first group intersects a longitudinal axis of one LED in the second group to define an intersection angle that ranges between 150 and 180 degrees.

11. The lighting fixture of claim 1, wherein each light module further includes a zener diode associated with a LED to form bypass circuitry.

12. The lighting fixture of claim 1, further comprising a cover that extends between opposed ends of the housing, the cover having opposed side segments, each segment having a tongue that is received by a recess at an uppermost end of each of the first and second external side walls of the housing.

13. The lighting fixture of claim 1, wherein the housing further includes a wing extending along a lowermost end of each support member and above the uppermost end of each external side wall, the wing having an inclined upper wall that is positioned above a lower edge of the LED.

14. The lighting fixture of claim 1, further comprising a wireless module that allows for remote operation of the fixture, the wireless module comprising a transmitter, a receiver, an antenna, and a control interface for the power supply.

15. A LED lighting fixture comprising:

an elongated external housing configured to be secured to an interior of a refrigerated cooler or freezer, the external housing having a first external side wall and a second external side wall, wherein a first support member extends upwardly from an uppermost end of the first external side wall and a second support member extends upwardly from an uppermost end of the second external side wall, and wherein the first and second support members converge at an elevated central wall that resides above the uppermost end of the first and second side walls, wherein the first and second external side walls, the first and second support members, and the central wall collectively define a U-shaped internal cavity of the housing with an open end configuration opposite the central wall;

a first group of light modules secured to an outer surface of the first support member, each light module comprising a light emitting diode (LED) mounted on a printed circuit board;

a second group of light modules secured to an outer surface of the second support member, each light module comprising a LED mounted on a printed circuit board; and, a cover that extends between opposed ends of the housing, the cover having opposed side segments, each segment having a tongue that is received by a recess at an uppermost end of each of the first and second external side walls of the housing.

16. The lighting fixture of claim 15, wherein the first group of light modules are secured to the first support member by first and second elongated fasteners, said elongated fasteners extending through the printed circuit board and into the first support member.

17. The lighting fixture of claim 16, further comprising:

a removable rear wall extending between a lowermost portion of the first and second external side walls, wherein the rear wall encloses the U-shaped internal cavity; and, a power supply residing within the housing between the first and second external side walls and adjacent the rear wall member extending between said side walls.

18. The lighting fixture of claim 16 wherein each light module includes a first copper trace on the printed circuit board extending between the first fastener and the LED, and a second copper trace extending between the second fastener and the LED.

19. The lighting fixture of claim 15, further comprising a first interconnection board inserted into a channel formed adjacent the inner surface of the first support member, and wherein first and second elongated fasteners secure the first group of light modules and the first interconnection board to the first support member.

20. The lighting fixture of claim 15, wherein the first and second support members define an internal arrangement angle that ranges between 30 and 100 degrees.

21. The lighting fixture of claim 15, wherein a longitudinal axis of one LED in the first group intersects a longitudinal axis of one LED in the second group to define an intersection angle that ranges between 150 and 180 degrees.

22. The lighting fixture of claim 15, further comprising a blocking wing extending along a lowermost end of each support member and at the uppermost end of each side wall, the blocking wing having an inclined upper wall that is positioned above a lower edge of the LED.

23. A lighting fixture for use in refrigerator coolers or freezers, the lighting fixture comprising:

an elongated external housing securable to an interior of a refrigerated cooler or freezer, the external housing having a first external side wall and a second external side wall, wherein a first angled support member integrally extends from an uppermost end of the first external side wall and a second angled support member integrally extends from an uppermost end of the second external side wall, wherein the first and second support members converge at an elevated central wall that is positioned opposite a removable rear wall extending between the first and second side walls, wherein the first and second external side walls, the first and second support members, and the central wall collectively define a U-shaped internal cavity that is enclosed by the removable rear wall, and the housing further having a wing extending along a lowermost end of each support member and above the uppermost end of the external side wall;

a first group of light modules secured to the first support member, each light module comprising a light emitting diode (LED) mounted on a printed circuit board; and, a second group of light modules secured to the second support member, each light module comprising a LED mounted on a printed circuit board.

24. The lighting fixture of claim 23, wherein the wing has a depending projection and the side wall includes a receiver, wherein the projection is slidingly received by the receiver to couple the wing to the housing.

25. The lighting fixture of claim 23, wherein the wing has upwardly extending inner wall and an inclined upper wall, wherein the upper wall is positioned above a lower edge of the LED.

26. The lighting fixture of claim 23, wherein the first group of light modules are secured to the first support member by first and second elongated fasteners, said elongated fasteners also extending through the printed circuit board and into the first support.

27. The lighting fixture of claim 23, wherein the wing resides outward of the first support member.

28. The lighting fixture of claim 23, wherein the lowermost end of the first support member resides inward of the uppermost end of the first side wall, whereby the first support member and the first side wall have a staggered configuration.

* * * * *